US012522323B2

(12) United States Patent
Streeter

(10) Patent No.: US 12,522,323 B2
(45) Date of Patent: Jan. 13, 2026

(54) MOORING APPARATUS

(71) Applicant: BayPointe Enterprises, Inc., Lake St. Croix Beach, MN (US)

(72) Inventor: William Todd Streeter, Lake St. Croix Beach, MN (US)

(73) Assignee: BayPointe Enterprises, Inc., Lake St. Croix Beach, MN (US)

( * ) Notice: Subject to any disclaimer, the term of this patent is extended or adjusted under 35 U.S.C. 154(b) by 44 days.

(21) Appl. No.: 18/486,001

(22) Filed: Oct. 12, 2023

(65) Prior Publication Data

US 2024/0043096 A1 Feb. 8, 2024

Related U.S. Application Data

(63) Continuation of application No. 17/353,252, filed on Jun. 21, 2021, now Pat. No. 11,820,466.

(51) Int. Cl.
*B63B 21/20* (2006.01)
*B63B 21/04* (2006.01)

(52) U.S. Cl.
CPC ..... *B63B 21/20* (2013.01); *B63B 21/04* (2013.01)

(58) Field of Classification Search
CPC . B63B 21/20; B63B 21/04; E02B 3/20; E02B 3/24
See application file for complete search history.

(56) References Cited

U.S. PATENT DOCUMENTS

| | | | |
|---|---|---|---|
| 2,550,913 | A | 5/1951 | Coffing |
| 3,429,289 | A | 2/1969 | Lezak |
| 3,430,599 | A | 3/1969 | Lezak |
| 3,430,600 | A | 3/1969 | Lezak |
| 3,695,209 | A | 10/1972 | Giese |
| 4,480,576 | A | 11/1984 | Mills |
| 5,014,638 | A | 5/1991 | Ilves et al. |
| 5,037,242 | A | 8/1991 | Nill |
| 5,293,831 | A | 3/1994 | Whitehead |
| 6,928,945 | B1 | 8/2005 | Tebo |
| 9,487,925 | B1 | 11/2016 | Meriwether et al. |
| 11,649,600 | B2 | 5/2023 | Golden |
| 2008/0022912 | A1 | 1/2008 | Smith |
| 2009/0071390 | A1 | 3/2009 | Brelsford |
| 2011/0168074 | A1 | 7/2011 | Brelsford |
| 2013/0061792 | A1 | 3/2013 | Brelsford |
| 2015/0336637 | A1 | 11/2015 | Brelsford |
| 2018/0178885 | A1 | 6/2018 | Hadcroft |
| 2022/0402576 | A1 | 12/2022 | Streeter |

FOREIGN PATENT DOCUMENTS

GB 2514091 A 11/2014

*Primary Examiner* — Anthony D Wiest
(74) *Attorney, Agent, or Firm* — Dorsey & Whitney LLP

(57) ABSTRACT

A mooring apparatus may allow for watercraft to be secured to a mooring structure. An example of a mooring apparatus includes a frame secured to a shell cover at a plurality of points, a plurality of rollers disposed within the frame, and a tension bar disposed within the frame and parallel to the plurality or rollers.

8 Claims, 5 Drawing Sheets

MOORING APPARATUS

CROSS REFERENCE TO RELATED APPLICATIONS

This application claims priority to U.S. patent application Ser. No. 17/353,252, filed Jun. 21, 2021, entitled "MOORING APPARATUS," now U.S. Pat. No. 11,820,466, which is incorporated by reference herein, in the entirety and for all purposes.

BACKGROUND

From large aircraft carriers to small recreational watercraft, ships and personal watercraft all have one thing in common, they must be affixed to a stationary object, platform or dock to keep it from drifting away while on the water but not in use. Watercraft of all types and sizes typically use properly sized tethers or mooring lines that are affixed to the watercraft on one end of the tether or mooring line and then affixed to a stationary structure such as a pier, pole, platform or dock on the other end. During calm weather, neither the watercraft nor the stationary mooring structure are vulnerable to damage caused when they slam into each other. However, during stormy and windy weather, high rolling waves will pitch the watercraft violently back and forth and will cause the watercraft to slam against the stationary structure, causing damage to the watercraft and to the mooring structure.

DETAILED DESCRIPTION

Figure 1:
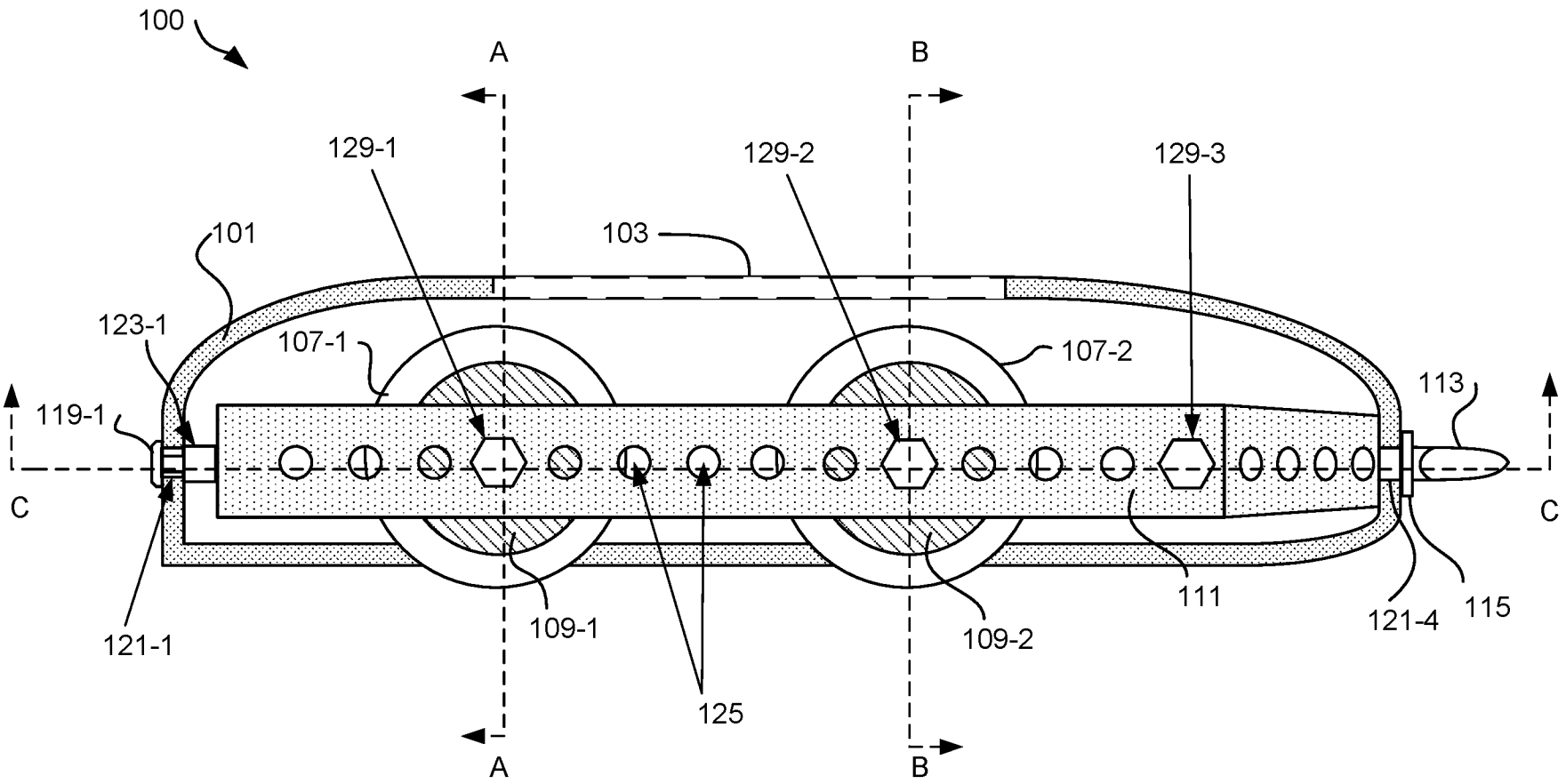
FIG. 1 illustrates a mooring apparatus with a shell cover, consistent with the present disclosure.

In the following detailed description, reference is made to the accompanying drawings which form a part hereof, and in which is shown by way of illustration specific examples in which the disclosure may be practiced. It is to be understood that other examples may be utilized and structural or logical changes may be made without departing from the scope of the present disclosure. The following detailed description, therefore, is not to be taken in a limiting sense, and the scope of the present disclosure is defined by the appended claims. It is to be understood that features of the various examples described herein may be combined, in part or whole, with each other, unless specifically noted otherwise.

During stormy and windy weather, rolling waves may cause a watercraft to pitch back and forth while being tethered to a stationary mooring structure such as a pier, pole, platform or dock. Under these conditions the oncoming wave rolls under the hull of the watercraft causing its bow to rise or pitch upward. The bow's upward force creates significant tension on the tether (mooring line, dock line or bow line). When this occurs, the mooring line may be stretched beyond its resting static state, creating enormous kinetic energy that is generated in the mooring line as it stretches. When the wave pushes the watercraft to the apex of the wave height, the built up energy and tension on the mooring line is immediately released the moment the bow begins to dip downward. This burst of released kinetic energy causes the mooring line to snap back into its natural static state causing the bow of the watercraft to recoil forcibly towards the mooring structure. This release of the mooring line's tension and energy results in the watercraft being slammed against the dock or mooring structure, a common problem for millions of watercraft owners.

Further examination reveals the stretched mooring line's kinetic energy is actually caused by the mooring line being tied to or affixed to one stationary point on the mooring structure which is the standard practice of tying a watercraft's mooring line to the mooring structure, pier, pole or cleat.

Accordingly, a need exists for a mooring apparatus that allows the mooring line to glide up the mooring pier or pole in unison with the rolling wave and rising bow of the watercraft.

According to an example of the present disclosure, a mooring apparatus may include a frame secured to a shell cover at a plurality of points, a plurality of rollers disposed within the frame, and a tension bar disposed within the frame and parallel to the plurality of rollers. In some examples, the frame includes a plurality of perforations, each perforation configured to receive a respective roller axis bolt. In some examples, the plurality of rollers each have a concave outer surface to receive the dock pole, pier, post or other appropriate size mooring structure. In some examples, a mooring line eyebolt is coupled to an end of the apparatus, the mooring line eyebolt to couple the apparatus to a mooring line. In some examples, the apparatus includes a first side to be coupled to a mooring line and a second side opposite the first side, the apparatus further including a tension bar extending a width of the frame proximal to the first side and distal to the second side. In some examples, the plurality of rollers include a first roller coupled to the frame via a first roller axis bolt extending through a first perforation in the frame and a second perforation in the frame, and a second roller coupled to the frame via a second roller axis bolt extending through a third perforation in the frame and a fourth perforation in the frame.

As another example, a mooring apparatus consistent with the present disclosure includes a frame including an elongated axis and a plurality of perforations disposed along a length of the frame, a tension bar extending across a width of the frame generally orthogonal to the elongated axis, and a roller disposed within the frame and generally orthogonal to the elongated axis, the roller to receive a mooring structure and to move along a length of the mooring structure via movement of the roller. In some examples, the apparatus includes a first roller disposed proximal to the tension bar and a second roller disposed distal to the tension bar. In some examples, the frame includes a tapered portion wherein the width of the frame reduces along the elongated axis to an apex, and wherein a mooring line eyebolt is fixedly secured to the apex of the frame. In some examples, the apparatus further includes a stopper bar, wherein the roller is disposed within the frame and distal to the tension bar, and the stopper bar is disposed between the roller and the tension bar. In some examples, the apparatus further includes a stopper bar, wherein the roller is disposed within the frame and proximal to the tension bar, and the stopper bar is disposed distal to the roller and the tension bar. In some examples, the roller is coupled to the frame via a roller axis bolt. In some examples, a location of the roller along the elongated axis of the frame is selectable based on placement of a roller axis bolt in a selected pair of perforations in the frame. In some examples, the roller is secured to the frame via a roller axis bolt, the roller axis bolt extending through a first perforation on a first elongated side of the frame and a second perforation on a second elongated side of the frame. In some examples a second roller is secured to the frame via a second roller axis bolt, the second roller axis bolt extending through a third perforation on the first elongated side of the frame and a fourth perforation on the second elongated side of the frame. In some examples the roller includes a second frame disposed within the first frame, the second frame including a plurality of rolling structures disposed thereon.

As a further example, a method of securing a mooring structure to a mooring apparatus includes receiving in a receiving chamber of an apparatus, a mooring structure, and securing the apparatus to the mooring structure. Securing the apparatus to the mooring structure may include placing the mooring structure between a roller structure and a stopper bar orthogonal to the bar receiving chamber such that the roller structure enables the apparatus to move along a length of the mooring structure. In some examples, securing the mooring apparatus to the mooring structure includes placing the mooring structure between a first roller structure and a second roller structure disposed on the stopper bar. In some examples, securing the apparatus to the mooring structure includes selecting a plurality of perforations along the frame of the apparatus to hold the roller structure.

Figure 2A:
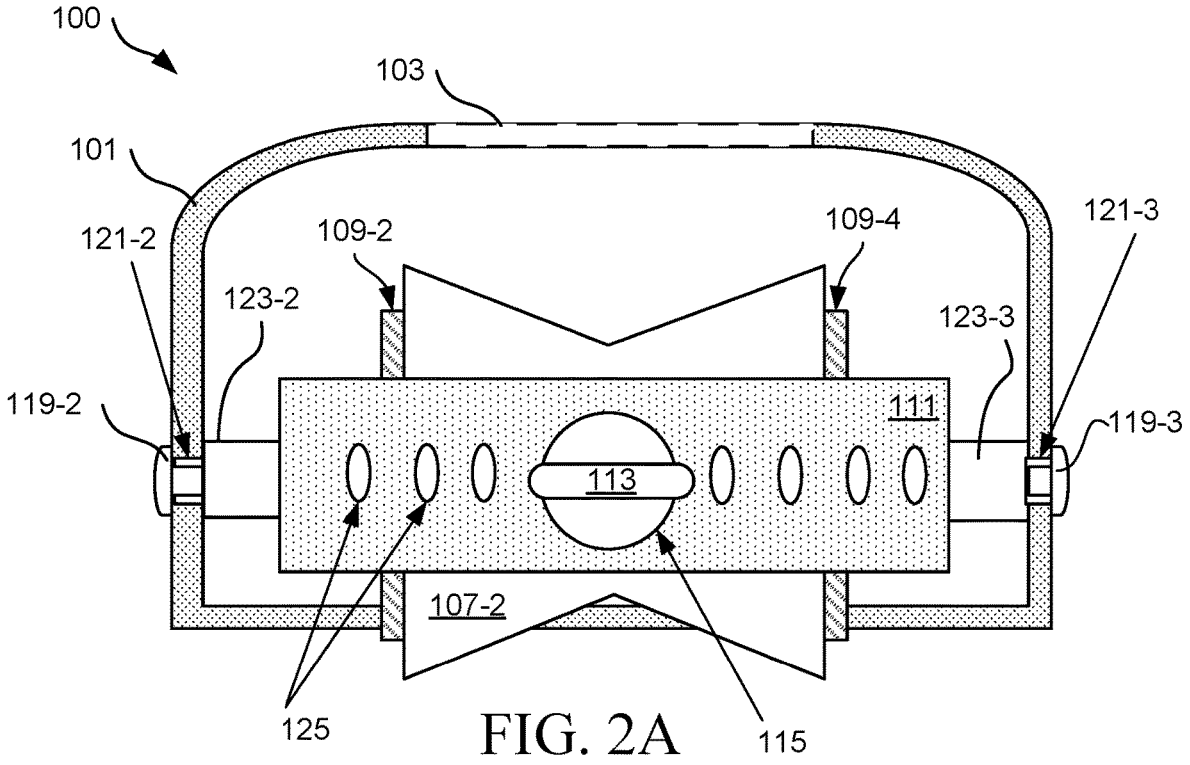
FIG. 2A illustrates a front view of the mooring apparatus with a shell cover, consistent with the present disclosure.
Figure 2B:
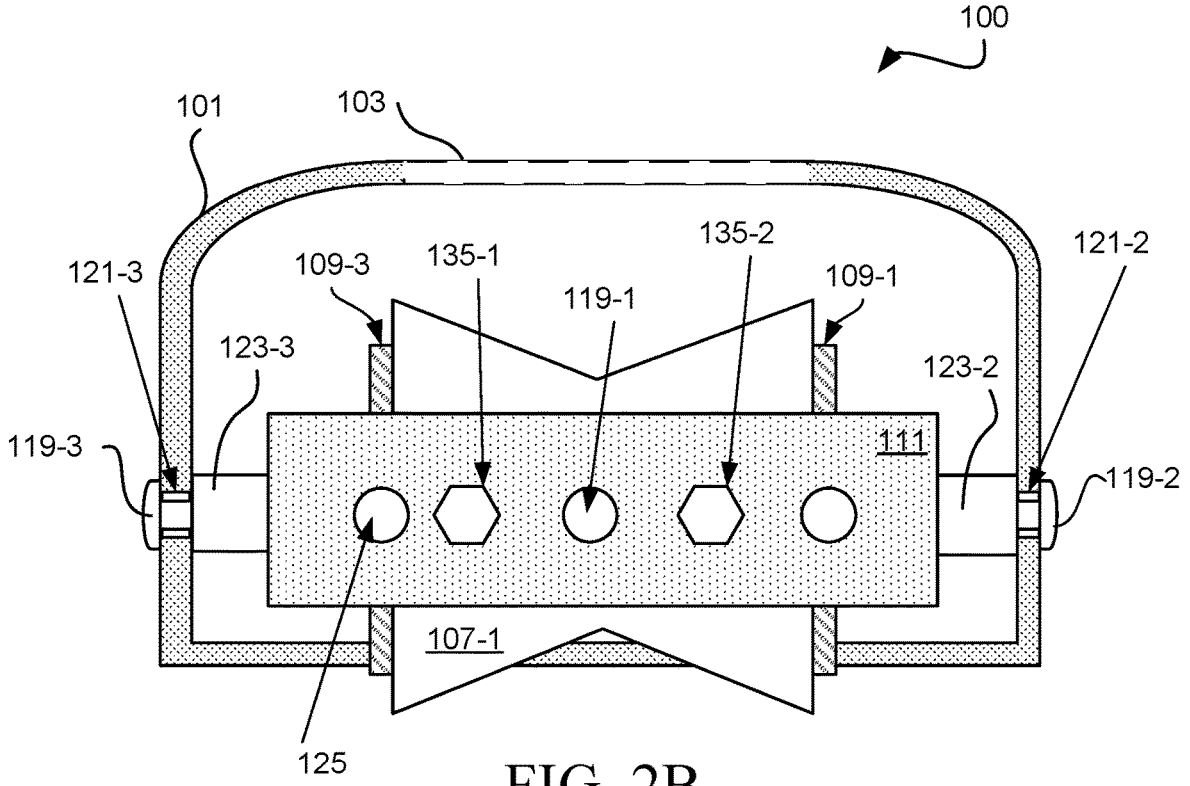
FIG. 2B illustrates a rear view of the mooring apparatus with a shell cover, consistent with the present disclosure.
Figure 3:
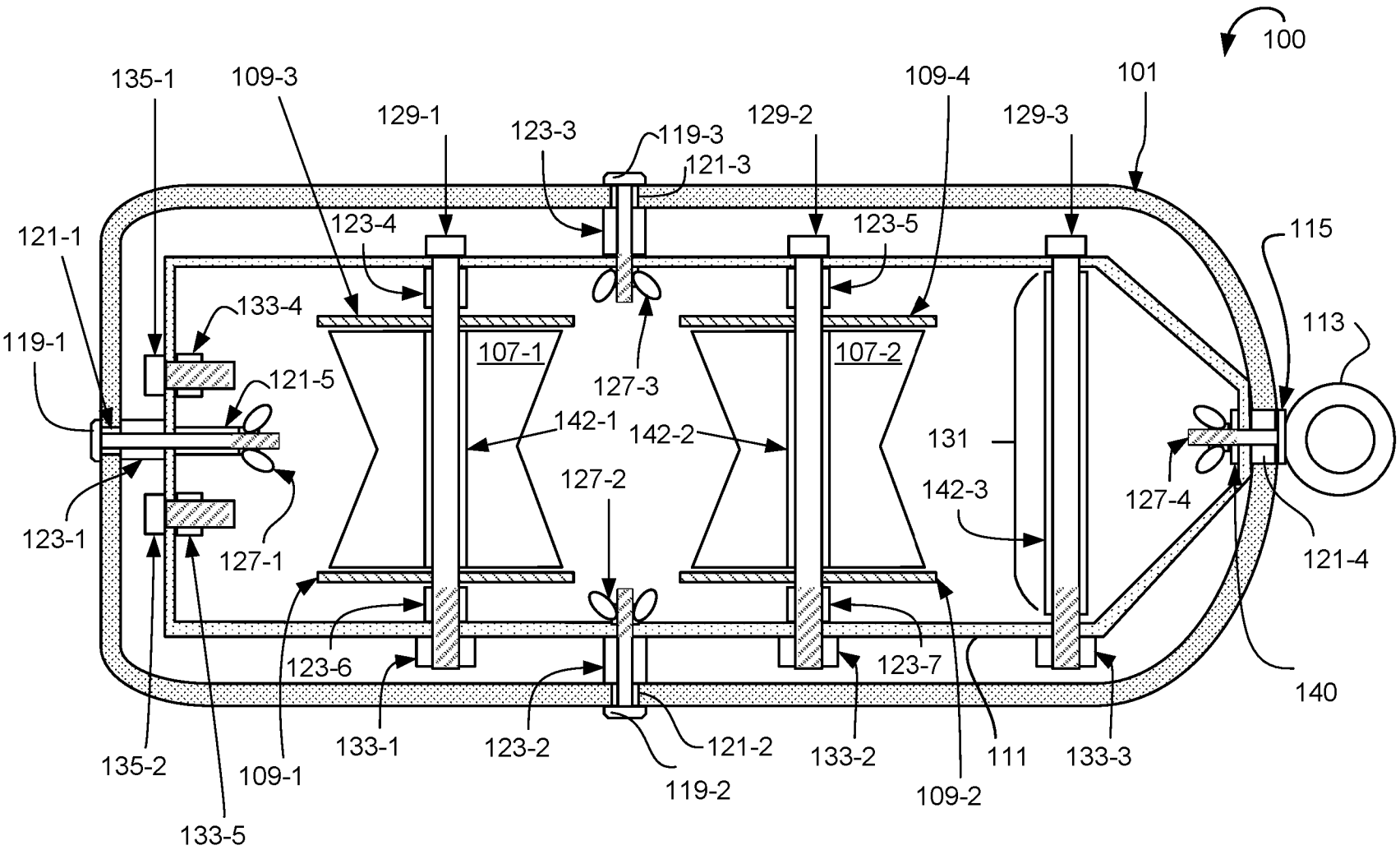
FIG. 3 illustrates a cross-sectional view of the mooring apparatus with a shell cover, consistent with the present disclosure.

Turning now to the Figures, FIG. 1 illustrates a mooring apparatus with a shell cover, consistent with the present disclosure. In particular, FIG. 1 illustrates a mooring apparatus 100 with a shell cover 101 from a side perspective. FIG. 2A illustrates a front view of apparatus 100 along axis B-B; FIG. 2B illustrates a rear view of apparatus 100 along axis A-A; and FIG. 3 illustrates a cross-sectional view of apparatus 100 along axis C-C, consistent with the present disclosure. In various examples the apparatus 100 includes a shell cover 101. As used herein, the shell cover refers to or includes a material extending over an area of the apparatus as illustrated in FIG. 1. The shell cover 101, may include a Plexiglas cover, a metal cover, a composite of reinforced plastic, and/or any other suitable material. In some examples, the shell cover may include an opening 103, as discussed further herein. Generally, the shell cover 101 refers to or includes a removable high-impact shell cover comprising plastic or other material that protects marine rollers from the elements.

In various examples, the apparatus includes a frame 111 that is secured to the shell cover 101 at a plurality of points. For example, referring to FIG. 1, FIG. 2A and FIG. 2B, and FIG. 3, the frame 111 may be secured to the shell cover 101 by a plurality of fastening means. For instance, as illustrated in FIG. 1, the frame 111 may be secured to the shell cover 101 by fastening means 119-1, and also by fastening means 113. Referring to FIG. 2A and FIG. 2B, and FIG. 3, the frame 111 may be secured to the shell cover 101 by fastening means 119-1, 119-2, 119-3, and 113. The frame 111 may be secured to the shell cover 101 at more or fewer points than illustrated. The frame 111 may be secured to the shell cover 101 by wing nuts 127-1, 127-2, 127-3, and 127-4, as illustrated, and/or by any other fastening means. Wing nut 127-4 may be separated from the frame 111 by a spacer 140. In some examples, spacer 140 may comprise a locking eyebolt washer, although examples are not so limited.

In some examples, additional material may be provided between the fastening means, the shell cover 101, and/or the frame 111. For example, spacers 121-1, 121-2, 121-3, 121-4, and 121-5 may be used to protect the shell cover 101 from the frame 111 and/or from the fastening means. As used herein, a spacer refers to or includes an additional material such as plastic, rubber, composite, and/or any other material capable of absorbing forces applied by the frame 111 and/or the shell cover 101. Also, as illustrated, additional spacers 123-1, 123-2, 123-3, 123-4, 123-5, 123-6, and 123-7 may be used to protect the shell cover 101 from the frame 111 and/or to protect a roller 107-1 and/or 107-2 from the frame 111.

In some examples, a mooring ring may be attached to a front portion of the shell cover 101. Referring to FIG. 3, an eyebolt 113 may be fixedly secured to the shell cover 101 by a wingnut 127-4 or other fastening means. For instance, a mooring line eyebolt may be coupled to an end of the apparatus 100, as illustrated. The mooring line eyebolt may couple the apparatus 100 to a mooring line. Although an eyebolt is described herein that is fixedly secured to the shell cover 101, the shell cover 101 may be a molded structure that includes an eyebolt or circular component that forms a part of the shell cover 101. Additionally and/or alternatively, the frame 111 may include a circular extension and/or an eyebolt loop or other fastening structure that serves as an attachment receptacle for a mooring line.

Referring again to FIG. 1, the shell cover 101 may cover and protect an internal frame 111. FIG. 1 illustrates a side perspective of apparatus 100; FIG. 2A illustrates a front view of apparatus 100 along axis B-B; FIG. 2B illustrates a rear view of apparatus 100 along axis A-A; and FIG. 3 illustrates a cross-sectional view of apparatus 100 along axis C-C, consistent with the present disclosure. As illustrated in FIG. 1, FIG. 2A, FIG. 2B, and FIG. 3, the apparatus 100 may include a plurality of rollers disposed within the frame. For instance, apparatus 100 may include rollers 107-1 and 107-2. Each of the respective rollers 107-1 and 107-2 may be disposed on a tube 142-1 and 142-2, that permit the respective rollers 107-1 and 107-2 to securely roll on respective bolts 129-1 and 129-2.

In some examples, the frame 111 may include a tapered portion wherein the width of the frame 111 reduces along an elongated axis to an apex, where the mooring line eyebolt 113 or other mooring line receptacle is fixedly secured to the apex of the frame 111. For instance, referring to FIG. 3, the frame 111 tapers from the bolt 129-3 toward the apex of the frame 111 where the mooring line eyebolt 113 is affixed. In various examples, the elongated axis expands to a widest point where a tension bar 131 is disposed within the frame 111.

As used herein, a tension bar 131 refers to or includes a solid, rigid structure that may be fixedly secured to the frame 111. In some examples, the tension bar includes a bar receiving chamber 142-3 which refers to or includes a hallow tube structure that permits passage of a reinforcing structure and/or material to pass there through. In some examples, the bar receiving chamber is configured to receive a bolt 129-3 or other reinforcing apparatus which may be fixedly secured to the frame 111. In some examples, the bar receiving chamber 142-3 comprises an aluminum tube. Collectively, the bar receiving chamber and the received material are referred to herein as a "tension bar." Additionally and/or alternatively, a singular component may comprise the tension bar 131 and may be fixedly secured to the frame 111. In some examples, the tension bar 131 is a separate component from the frame 111. Additionally and/or alternatively, the tension bar 131 may be formed as a part of the frame 111. The tension bar 131 may operate to absorb tension from the mooring line coupled to the mooring line receptacle, thereby dispersing forces applied to the frame 111.

As described further herein, a plurality of rollers 107-1 and 107-2 allow the apparatus 100 to roll along a mooring structure which could be anything from a pier to a platform, dock, dock pole, post, dock cleat, tree stump and/or any other appropriately sized structure. In some examples, the apparatus 100 includes a first side to be coupled to a mooring line and a second side opposite the first side, the apparatus further including a tension bar 131 extending a width of the frame 111 proximal to the first side and distal to the second side.

As illustrated in FIG. 1, the frame includes a plurality of perforations 125, each perforation configured to receive a respective roller axis bolt 129-1 and 129-2. As used herein, the frame 111 may refer to or include a solid metal strap formed in a rigid manner, having a rectangular portion and a tapered portion, as well as perforations allowing for receipt of configurable roller assembly.

In some examples the plurality of rollers 107-1 and 107-2 each have a concave outer surface to receive, the mooring structure. Examples are not limited to those illustrated, and other shapes and/or configurations of rollers may be used.

The plurality of perforations around the frame 111 may allow for different arrangements and/or configurations of rollers in the apparatus 100. For instance, the plurality of rollers may include a first roller 107-1 coupled to the frame 111 via a first roller axis bolt 129-1 extending through a first perforation in the frame and a second perforation in the frame, and a second roller 107-2 coupled to the frame via a second roller axis bolt extending through a third perforation in the frame and a fourth perforation in the frame. For instance, the frame 111 may include a plurality of perforations, each perforation corresponding to a different respective selectable position for coupling of a roller therein. Although examples are described with regards to an apparatus with a shell cover, embodiments are not so limited. As discussed and illustrated with regards to FIG. 4, various examples are contemplated in which the shell cover is removed.

Figure 4:
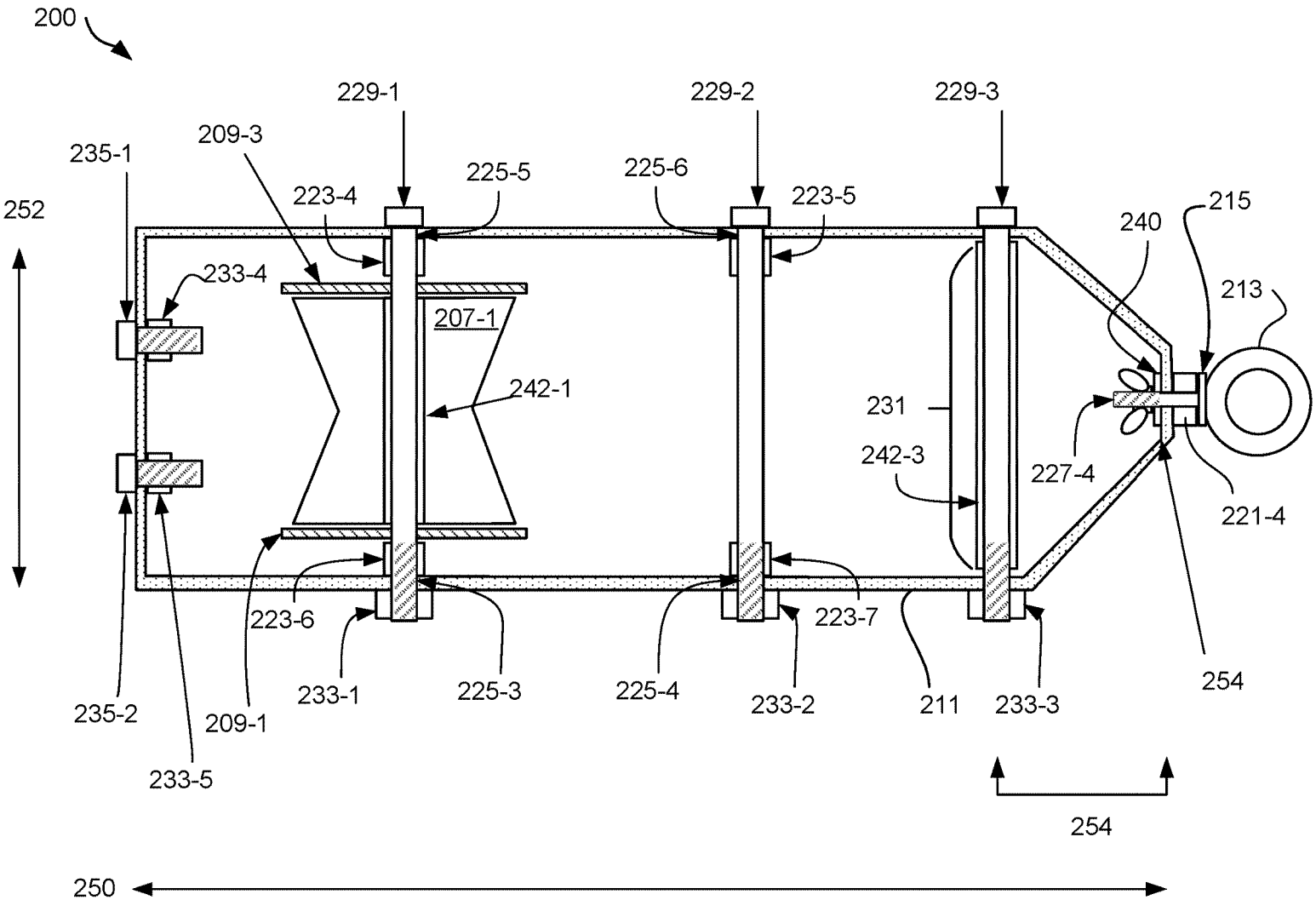
FIG. 4 illustrates an example mooring apparatus without a shell cover, consistent with the present disclosure.

FIG. 4 illustrates an example mooring apparatus 200 without a shell cover, consistent with the present disclosure. The apparatus 200 may be similar to the apparatus 100 illustrated in FIG. 1, FIG. 2, and FIG. 3, and similar structures are numbered similarly. For instance, internal frame 211 may be the same as or similar to internal frame 111; roller 207-1 may be the same as or similar to roller 107-1; spacer 221-4 may be the same as or similar to spacer 121-4; eyebolt 213 may be the same as or similar to eyebolt 113; wingnut 227-4 may be the same as or similar to wingnut 127-4; bolts 229-1, 229-2, and 229-3 may be the same as or similar to bolt 129-1, 129-2, and 129-3, respectively; tension bar 231 may be the same as or similar to tension bar 131; perforations 225 may be the same as or similar to perforations 125; spacer 240 may be the same as or similar to spacer 140; and tubes 242-1 and 242-3 may be the same as or similar to tubes 142-1 and 142-3.

Figure 5:
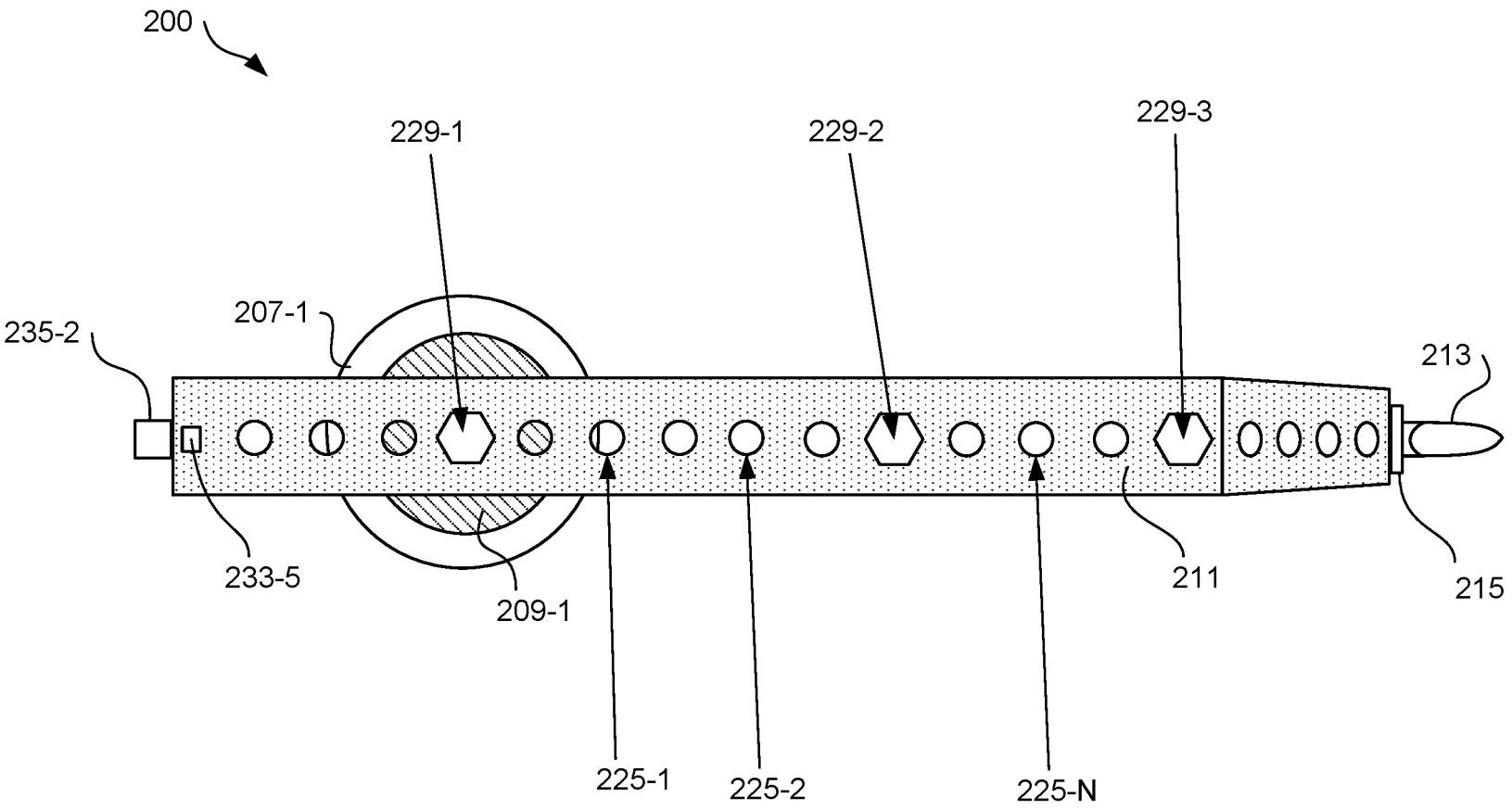
FIG. 5 illustrates an example mooring apparatus without a shell cover from a side perspective.

As illustrated in FIG. 4, apparatus 200 may comprise a frame 211 including an elongated axis, such as axis 250. FIG. 5 illustrates the apparatus 200 from a side perspective along axis 250. The apparatus 200 may include a plurality of perforations disposed along a length of the frame. FIG. 5 illustrates a plurality of perforations, though three perforations, 225-1, 225-2, and 225-N are numbered for the ease of reading FIG. 5. The apparatus 200 may include more or fewer perforations than illustrated. For instance, FIG. 5 illustrates eighteen perforations, in which perforations 225-1, 225-2, and 225-N are numbered. The use of "N" indicates that any number greater than 1 may substitute the letter N, indicating that any number of perforations may be included in the frame 211 of apparatus 200. Collectively, perforations 225-1, 225-2, . . . 225-N are referred to herein as perforations 225.

As illustrated in FIG. 4 and FIG. 5, bolts 229-1, 229-2, and 229-3 may extend through different respective 225. For instance, the apparatus 200 may include a tension bar 231 extending across a width of the frame 211 generally orthogonal to the elongated axis 250. For instance, tension bar 231 may extend along axis 252. Similarly, the apparatus 200 may include a roller 271-1 disposed within the frame 211 and generally orthogonal to the elongated axis 250, the roller to receive a mooring structure and to move along a length of the mooring structure via movement of the roller 271-1.

As illustrated in FIG. 4 and FIG. 5, a first roller 271-1 may be disposed proximal to the tension bar 231. In some examples, the apparatus 200 may include a second roller disposed distal to the tension bar 231 relative to the first roller 271-1. For instance, another roller may be disposed on bolt 229-2, such as roller 171-2 illustrated in FIG. 1, FIG. 2, and FIG. 3. The shape and/or dimensions of the plurality of rollers (e.g., roller 171-1 and roller 271-2) may be the same and/or different. For example, roller 171-1 illustrated in FIG. 1 may have a concave surface whereas roller 171-2 may have a flat surface.

In some examples, the frame 211 includes a tapered portion 254 wherein the width of the frame 211 reduces along the elongated axis 250 to an apex 254. As illustrated, a mooring line eyebolt 213 may be fixedly secured to the apex 254 of the frame 211.

In some examples, the apparatus 200 further includes a stopper bar. As used herein, a stopper bar refers to or includes a solid structure comprising and/or disposed on a bolt extending through frame 211. Non-limiting examples of a stopper bar include a rubber and/or plastic bar through which bolt 229-2 extends. The stopper bar may serve as a resistive force that holds the mooring structure in place within the apparatus 200 and in contact with roller 207-1. As such, the roller 207-1 may be disposed within the frame 211 and distal to the tension bar 231, and the stopper bar may be disposed between the roller 207-1 and the tension bar 231 (such as on bolt 229-2). In some examples, bolt 227-2 may itself serve as a stopper bar.

As illustrated in each of FIG. 1, FIG. 2, FIG. 2, FIG. 4, and FIG. 5, various bolts may extend through perforations 225 in the frame 211. While three bolts 229-1, 229-2, and 229-3 are illustrated in FIG. 4 and FIG. 5, it is noted that more or fewer bolts may be used. In some examples, a bolt may be referred to as a roller axis bolt. For instance, roller 207-1 may be coupled to the frame 211 via a roller axis bolt (e.g., bolt 229-1).

In some examples, a location of the roller 207-1 along the elongated axis 250 of the frame 211 is selectable based on placement of a roller axis bolt (e.g., bolt 229-1) in a selected pair of perforations in the frame 211. For instance, referring to FIG. 5, the location of roller 207-1 may be selected by placing bolt 229-1 in perforation 225-1, perforation 225-2, or perforation 225-N, for example. The stopper bar and/or second roller location may be selected by placing bolt 229-2 in perforation 225-1, perforation 225-2, or perforation 225-N, for example.

In some examples, the roller 207-1 is secured to the frame 211 via a roller axis bolt, and the roller axis bolt extends through a first perforation 225-3 on a first elongated side of the frame 211 and a second perforation 225-5 on a second elongated side of the frame 211. As discussed herein, a second roller may be secured to the frame 211 via a second roller axis bolt, the second roller axis bolt extending through a third perforation 225-4 on the first elongated side of the frame 211 and a fourth perforation 225-6 on the second elongated side of the frame 211. In some examples, the roller 207-2 may include a second frame disposed within the first frame 211, and the second frame may include a plurality of rolling structures disposed thereon.

Various examples of the present disclosure include a method of securing a mooring structure to a mooring apparatus. The method may include receiving in a receiving chamber of an apparatus, a mooring structure. As used herein, a receiving chamber may refer to or include the opening 103. The method further includes securing the apparatus to the mooring structure. In some examples, the mooring structure is secured to the apparatus by placing the mooring structure between a roller structure and a stopper bar orthogonal to the bar receiving chamber such that the roller structure enables the apparatus to move along a length of the mooring structure. For instance, the mooring structure may be secured to the mooring apparatus 200 by placing the mooring structure between the roller 207-1 and the stopper bar on and/or comprising bolt 229-2.

In some examples, the method includes securing the mooring apparatus to the mooring structure by placing the mooring structure between a first roller structure and a second roller structure disposed on the stopper bar. For instance, referring to FIG. 1, the mooring apparatus 100 may be secured to a mooring structure by placing the mooring structure between roller 107-1 and roller 107-2. In various examples, securing the apparatus to the mooring structure may include selecting a plurality of perforations along the frame of the apparatus to hold the roller structure. For instance, securing the mooring apparatus 200 to a mooring structure may include selecting perforations 225 on the frame 211, placing a roller, a plurality of rollers, and/or a stopper bar on the frame 211 by extending bolts (e.g., 229) through the perforations 225, and placing the mooring apparatus 200 on the mooring structure.

Although specific examples have been illustrated and described herein, a variety of alternate and/or equivalent implementations may be substituted for the specific examples shown and described without departing from the scope of the present disclosure. This application is intended to cover any adaptations or variations of the specific examples discussed herein. Therefore, it is intended that this disclosure be limited only by the claims and the equivalents thereof.

What is claimed:

1. An apparatus, comprising:

a frame including an elongated axis and a plurality of perforations disposed along a length of the frame;

a tension bar extending across a width of the frame generally orthogonal to the elongated axis; and a roller disposed within the frame and generally orthogonal to the elongated axis, the roller to receive a mooring structure and to move along a length of the mooring structure via movement of the roller, wherein the roller is secured to the frame via a roller axis bolt, the roller axis bolt extending through a first perforation on a first elongated side of the frame and a second perforation on a second elongated side of the frame.

2. The apparatus of claim 1, including a first roller disposed proximal to the tension bar and a second roller disposed distal to the tension bar.

3. The apparatus of claim 1, wherein the frame includes a tapered portion wherein the width of the frame reduces along the elongated axis to an apex, and wherein a mooring line eyebolt is fixedly secured to the apex of the frame.

4. The apparatus of claim 1, further including a stopper bar, wherein the roller is disposed within the frame and distal to the tension bar, and the stopper bar is disposed between the roller and the tension bar.

5. The apparatus of claim 1, further including a stopper bar, wherein the roller is disposed within the frame and proximal to the tension bar, and the stopper bar is disposed distal to the roller and the tension bar.

6. The apparatus of claim 1, wherein a location of the roller along the elongated axis of the frame is selectable based on placement of the roller axis bolt in a selected pair of perforations in the frame.

7. The apparatus of claim 1, wherein a second roller is secured to the frame via a second roller axis bolt, the second roller axis bolt extending through a third perforation on the first elongated side of the frame and a fourth perforation on the second elongated side of the frame.

8. The apparatus of claim 1, wherein the roller includes a second frame disposed within the first frame, the second frame including a plurality of rolling structures disposed thereon.

* * * * *